US009192035B2

(12) United States Patent
Mao

(10) Patent No.: US 9,192,035 B2
(45) Date of Patent: Nov. 17, 2015

(54) RELAMPING CIRCUIT

(75) Inventor: Zhu Mao, Shaghai (CN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/413,296

(22) PCT Filed: Jul. 17, 2012

(86) PCT No.: PCT/CN2012/078738

§ 371 (c)(1),
(2), (4) Date: Jan. 8, 2015

(87) PCT Pub. No.: WO2014/012213

PCT Pub. Date: Jan. 23, 2014

(65) Prior Publication Data

US 2015/0195894 A1 Jul. 9, 2015

(51) Int. Cl.

| | |
|---|---|
| ***H05B 37/02*** | (2006.01) |
| ***H05B 41/295*** | (2006.01) |
| ***H05B 41/298*** | (2006.01) |
| ***H05B 41/38*** | (2006.01) |

(52) U.S. Cl.

CPC ..... *H05B 41/295* (2013.01); *H05B 41/2985* (2013.01); *H05B 41/386* (2013.01)

(58) Field of Classification Search

CPC ..... H05B 41/2855; H05B 41/2828; H05B 41/28; H05B 41/295; H05B 41/2985; H05B 41/298; H05B 41/233; Y10S 315/05; Y10S 315/07

USPC ..... 315/225, 224, 127, 291, 307, 209 R, 315/105, 244, DIG. 5, DIG. 7

See application file for complete search history.

(56) References Cited

U.S. PATENT DOCUMENTS

| | | | | |
|---|---|---|---|---|
| 5,436,529 | A | 7/1995 | Bobel | |
| 5,770,925 | A * | 6/1998 | Konopka | H05B 41/2985 315/127 |
| 5,877,592 | A * | 3/1999 | Hesterman | H05B 41/295 315/105 |
| 5,883,473 | A * | 3/1999 | Li | H05B 41/2855 315/209 R |
| 6,366,032 | B1 | 4/2002 | Allison et al. | |
| 2003/0189411 | A1 | 10/2003 | Sridharan et al. | |
| 2005/0168161 | A1 | 8/2005 | Chiou | |
| 2010/0301752 | A1 | 12/2010 | Bakre et al. | |
| 2011/0006699 | A1 | 1/2011 | Nerone | |

OTHER PUBLICATIONS

International Search Report and Written Opinion dated Apr. 4, 2013 which was issued in connection with PCT Patent Application No. PCT/CN2012/078738 which was filed on Jul. 16, 2012.

* cited by examiner

*Primary Examiner* — Haissa Philogene

(74) *Attorney, Agent, or Firm* — Ge Global Patent Operation; Peter T. DiMauro

(57) ABSTRACT

A relamping circuit topology to provide a lamping signal in ballast circuits used to power heated filament gas discharge lamps. The relamping circuit includes a low level DC power source, a differential capacitance and a switching device coupled to the differential capacitance. The differential capacitance is configured to produce a relamping signal. The relamping circuit topology also includes an electric current path configured to direct a flow of direct current from the low level DC power supply through a filament of the gas discharge lamp, and to the differential capacitance such that breaking and restoring the electric current path activates the relamping signal.

18 Claims, 4 Drawing Sheets

RELAMPING CIRCUIT

BACKGROUND

Aspects of the present disclosure relate generally to electric power conversion circuits for driving gas discharge lamps, and in particular to relamping circuits for use in ballast circuits for gas discharge lamps.

Heated filament gas discharge lamps, such as the fluorescent lamp common in homes and commercial buildings, are a type of electric light generating device that create light by passing an electric current through a mixture of gases contained within a sealed tube or bulb. To initiate light production, or ignite the lamp, filaments at ends of the tube are heated and a relatively high voltage, known as an ignition voltage, is applied across the lamp to ionize the gases and initiate an arc within the lamp tube. Once an arc has been established and the filaments have warmed enough to sustain thermionic emissions, the lamp enters a steady state where light production can be maintained with a lower voltage. During steady state operation, gas discharge lamps exhibit phenomena known as negative resistance, where increasing current results in lower electric resistance. This negative resistance can create an unstable current condition, that if left unchecked, will destroy the lamp. To overcome this problem, gas discharge lamps are typically driven with current limiting driver circuits that prevent high currents from damaging the lamps. These current limiting driver circuits are known as ballast circuits or ballasts.

A common type of ballast circuit used to drive fluorescent lamps is a resonant inverter circuit. Resonant inverters have properties that are particularly well suited to driving gas discharge lamps. For example, resonant inverters can provide the relatively high ignition voltages, can control current delivered to the lamps, and can provide improved lamp life. These resonant inverters typically receive a DC voltage and use a set of switching devices to apply an AC voltage to a resonant LC circuit to produce a high frequency lamp power. The voltage of the lamp power can be easily regulated by adjusting the frequency of the AC voltage, while current is easily controlled by proper selection of a capacitor size. As the frequency of the AC voltage is moved closer to or farther away from the resonant frequency of the resonance of the LC circuit, the voltage of the lamp power is increased or reduced respectively.

It is often desirable to replace lamps in light fixtures without turning the fixtures off. To overcome this problem many lamp ballasts include relamping circuits that sense failed or removed lamps and shut down the ballast and restart the ballast when a new lamp is installed. However, many fixtures used a single ballast to drive multiple lamps and this approach makes it difficult to determine which lamp failed and can also reduce light levels around the fixture making it difficult to install new lamps. Typical relamping circuits also use a high number of components thereby increasing costs and lowering reliability.

Accordingly, it would be desirable to provide a relamping circuit topology that solves at least some of the problems identified above.

SUMMARY OF THE INVENTION

As described herein, the exemplary embodiments overcome one or more of the above or other disadvantages known in the art.

One aspect of the present disclosure relates to a relamping circuit for a ballast circuits used to power heated filament gas discharge lamps. In one embodiment, the relamping circuit includes a low level DC power supply, a differential capacitance, and a switching device coupled to the differential capacitance. The differential capacitance is configured to produce a relamping signal. The relamping circuit topology also includes an electric current path configured to direct a flow of direct current from the low level DC power supply through a filament of the gas discharge lamp and to the differential capacitor. Breaking and restoring the electric current path activates the relamping signal.

Another aspect of the present disclosure relates to a power conversion apparatus for operating a heated filament gas discharge lamp. In one embodiment, the apparatus includes a resonant inverter to produce the AC lamp power. A relamping circuit is coupled to the filament of the lamp and produces a relamping signal. The apparatus also includes a frequency controller coupled to the resonant inverter and configured to regulate a frequency of the AC inverter power at an ignition frequency and at an operating frequency. The relamping circuit includes a low level DC power source, a differential capacitance, a switching device coupled to the differential capacitance that is configured to produce a relamping signal, and an electric current path configured to direct a flow of direct current from the low level DC power source, through a filament of the gas discharge lamp, and to the differential capacitance. The relamping circuit is configured such that breaking and restoring of the electric current path activates the relamping signal. The relamping signal is coupled to the frequency controller such that activation of the relamping signal causes the frequency controller to regulate the inverter at the ignition frequency for a predetermined period of time then regulate the inverter at the operating frequency.

Another aspect of the present disclosure relates to a power conversion apparatus to operate a heated filament gas discharge lamp. In one embodiment, the apparatus includes a resonant inverter to produce an AC lamp power. A relamping circuit is coupled to the resonant inverter and is coupled to the filament of the lamp and configured to produce a relamping signal. The apparatus also includes a frequency controller comprising an integrated circuit configured to operate the inverter in a lamp startup sequence and at a lamp operating frequency. The integrated circuit has a resetting input configured to re-start the lamp startup sequence. The relamping circuit includes a low level DC power source, a differential capacitance, a resistance coupled to the differential capacitance and to the resetting input such that a relamping signal is applied to the resetting input, and an electric current path configured to direct a flow of direct current from the low level DC power source through a filament of the gas discharge lamp and to the differential capacitance. The relamping circuit is configured such that breaking and restoring the electric current path activates the relamping signal and causes the integrated circuit to re-start the lamp startup sequence.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DETAILED DESCRIPTION OF THE DISCLOSED EMBODIMENTS

Figure 1:
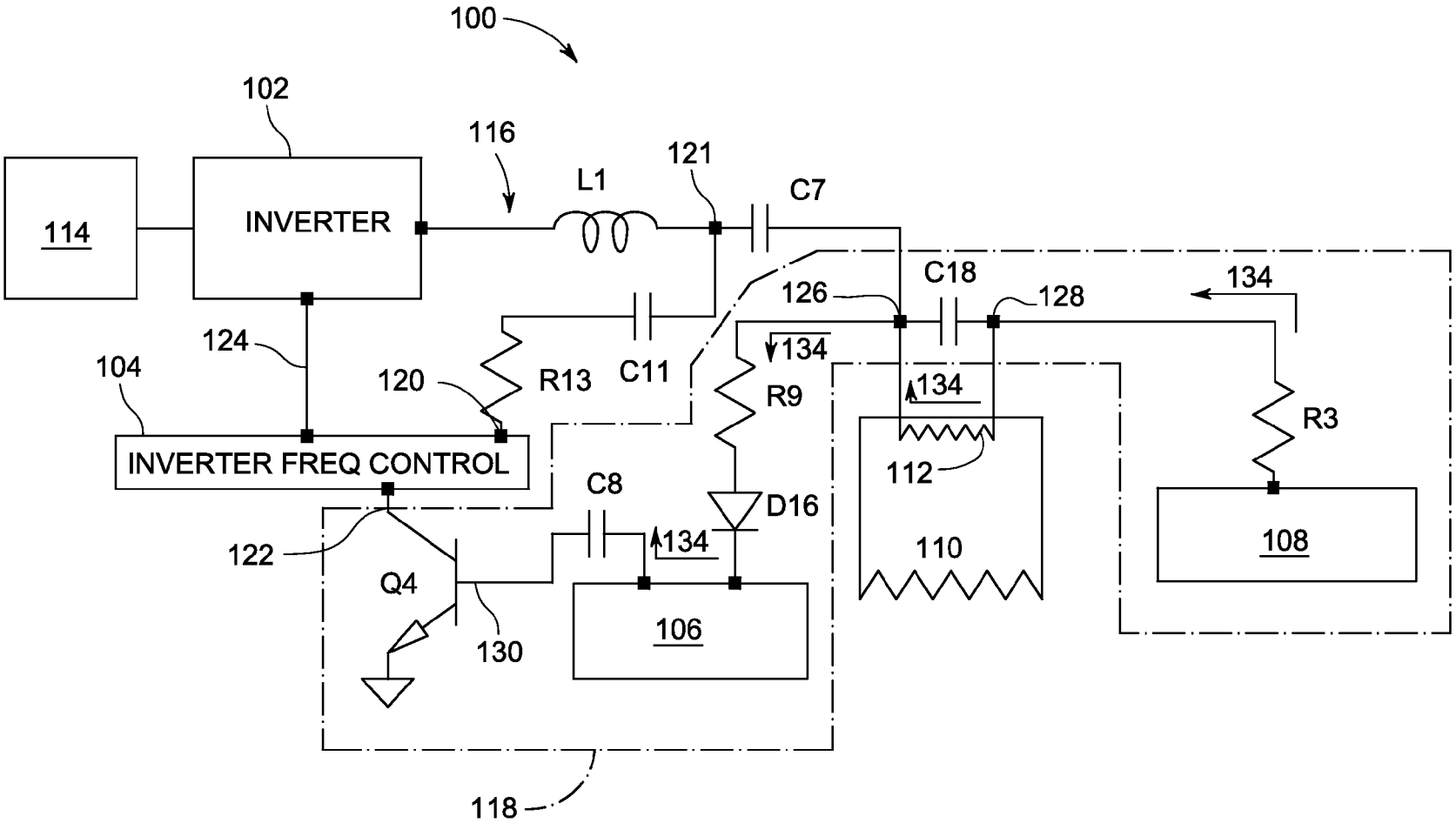
FIG. 1 illustrates an exemplary relamping circuit topology incorporating aspects of the present disclosure.

Reference will now be made in detail to the various embodiments, one or more examples of which are illustrated in the drawings. Each example is provided by way of explanation and is not meant as a limitation. For example, features illustrated or described as part of one embodiment can be used on or in conjunction with other embodiments to yield yet further embodiments. It is intended that the present disclosure includes such modifications and variations.

FIG. 1 illustrates an embodiment of a relamping circuit topology 118 used in the resonant inverter lamp ballast 100 to power heated filament gas discharge lamp(s) 110. The resonant inverter lamp ballast 100 has an inverter 102 configured to receive a direct current (DC) supply voltage 114 and apply an alternating current (AC) voltage 116 to a resonant tank, formed by inductor L1 and capacitor C7, connected at node 121, which provides power to a lamp 110. The inverter 102 may be of any suitable type such as for example a full-bridge inverter, half-bridge inverter, etc., and may employ various types of switching devices, preferably semiconductor switching devices, such as field effect transistors, bipolar junction transistors etc. The gas discharge lamp 110 includes a filament 112 connected across a pair of lamp terminals 126, 128. Heating of the filament 112 induces thermionic emissions to produce light within the lamp 110. An inverter frequency control circuit 104, also referred to as inverter frequency controller 104, regulates the voltage of the resonant tank formed by the combination of the inductor L1 and capacitor C7. In one embodiment, the inverter frequency controller 104 is comprised of machine-readable instructions that are executable by a processing device.

In one embodiment, the inverter frequency controller 104 receives a control signal 120 that is proportional to the resonant tank voltage across a series connected resistor R13 and capacitor C11. The inverter frequency controller 104 provides a control signal 124, provided to the inverter 102, which is used to adjust the frequency of the AC voltage 116 produced by the inverter 102. In certain embodiments, the control signal 124 is generated by magnetically coupling components in the inverter frequency controller 104 with components in the inverter 102. An example of a magnetically coupled frequency control signal 124 will be provided below.

The relamping circuit topology 118 is incorporated into the ballast circuit 100 to provide relamping functionality by providing a relamping control signal 122 to the inverter frequency control circuit 104. The relamping control signal 122 goes inactive when a filament 112 of the lamp 110 burns out, or the lamp 110 is removed, and remains inactive until a new lamp 110 is installed. This means that the relamping signal 122 remains inactive during normal operation and when a lamp 110 is removed or when a filament 112 burns out. When a new lamp 110 is installed in the ballast 100, the relamping signal 122 goes active for a period of time. An relamping signal 122 that is in an active state triggers the inverter frequency controller 104 or other suitable control circuit to initiate an ignition cycle to ignite the newly installed lamp 110. In contrast to conventional relamping circuits, the relamping circuit 118 of the disclose embodiments remains inactive when a lamp 110 burns out or is removed, thereby allowing any remaining lamps 110 in a multiple lamp fixture to continue operating. It is only when a new lamp is installed that the relamping circuit 118 activates its relamping signal 122 to allow the replaced or new lamp 110 to be ignited.

The relamping circuit 118 provides an electrical path 134 for current to flow from a low level DC source 108 to a differential capacitance or capacitor C8, where it places a charge on the differential capacitor C8. The current path 134 is formed by a series connection of a resistor R3, the lamp filament 112, resistor R9 and diode D16. A blocking capacitance or capacitor C18 is placed across the lamp terminals 126 and 128 to prevent current from flowing when the lamp 110 is removed or the filament 112 is broken. A voltage filter 106 is coupled to the differential capacitor C8 to prevent unwanted voltage fluctuations from appearing in the voltage across the differential capacitor C8. Thus the voltage across C8 can be used to indicate breaking or restoring of the current path 134. When the current path 134 is broken, such as when filament 112 burns out or when lamp 110 is removed, or when the current path 134 is restored, such as when a new lamp 110 is installed, the differential capacitor C8 experiences a change in voltage.

In the embodiment shown in FIG. 1, the differential capacitor C8 is coupled to the control input 130 of a switching device Q4, which is shown in the form of a transistor. Through this coupling, voltages changes on the differential capacitor C8 can be used to turn the transistor Q4 on or off. When a positive going voltage pulse is applied to the differential capacitor C8, transistor Q4 is turned on, activating the relamping signal 122.

In normal, or steady state, operation a DC current flows along the current path 134 from the DC voltage source 108, through the first resistor R3, through the lamp filament 112, through the second resistor R9 and the diode D16, where it is filtered by the voltage filter 106 and applied to the differential capacitor C8. The differential capacitor C8 does not experience any voltage change during normal operation and thus the transistor Q4 remains off. When the lamp 110 burns out or is removed, the DC current path 134 is broken. The flow of current to the differential capacitor C8 is interrupted, creating a negative going voltage across the differential capacitor C8. A negative going voltage pulse across the differential capacitor C8 induces a pulse of negative current on the control input 130 of the transistor Q4 so the transistor Q4 is not turned on and the relamping signal 122 is not activated. When a new lamp 110 is placed into the circuit, the current path 134 is restored and a current begins to flow from the DC voltage source 108 to the differential capacitor C8 thereby creating a positive going voltage across the differential capacitor C8. This positive going voltage across the differential capacitor C8 induces a pulse of positive current on the control input 130 of the transistor Q4 so the transistor Q4 is turned on and the relamping signal 122 is activated. This activated relamping signal 122 is applied to the inverter frequency controller 104 and causes the inverter frequency controller 104 to initiate a lamp startup sequence to ignite the newly installed lamp 110. The lamp startup sequence includes various steps used to initiate ignition of the newly installed lamp 110, such as for example, operating the inverter 102 at a frequency below the resonant frequency of the resonant inverter circuit 100 to cause heating of the filaments 112, operating the resonant inverter 100 at a lamp ignition frequency, or alternatively sweeping the frequency through the lamp ignition frequency such that an arc is formed in the lamp 110, or other such steps that will cause ignition of a particular gas discharge lamp. Any lamp startup sequence that will reliably ignite the lamp 110 may be advantageously employed with the disclosed relamping circuits.

Figure 2:
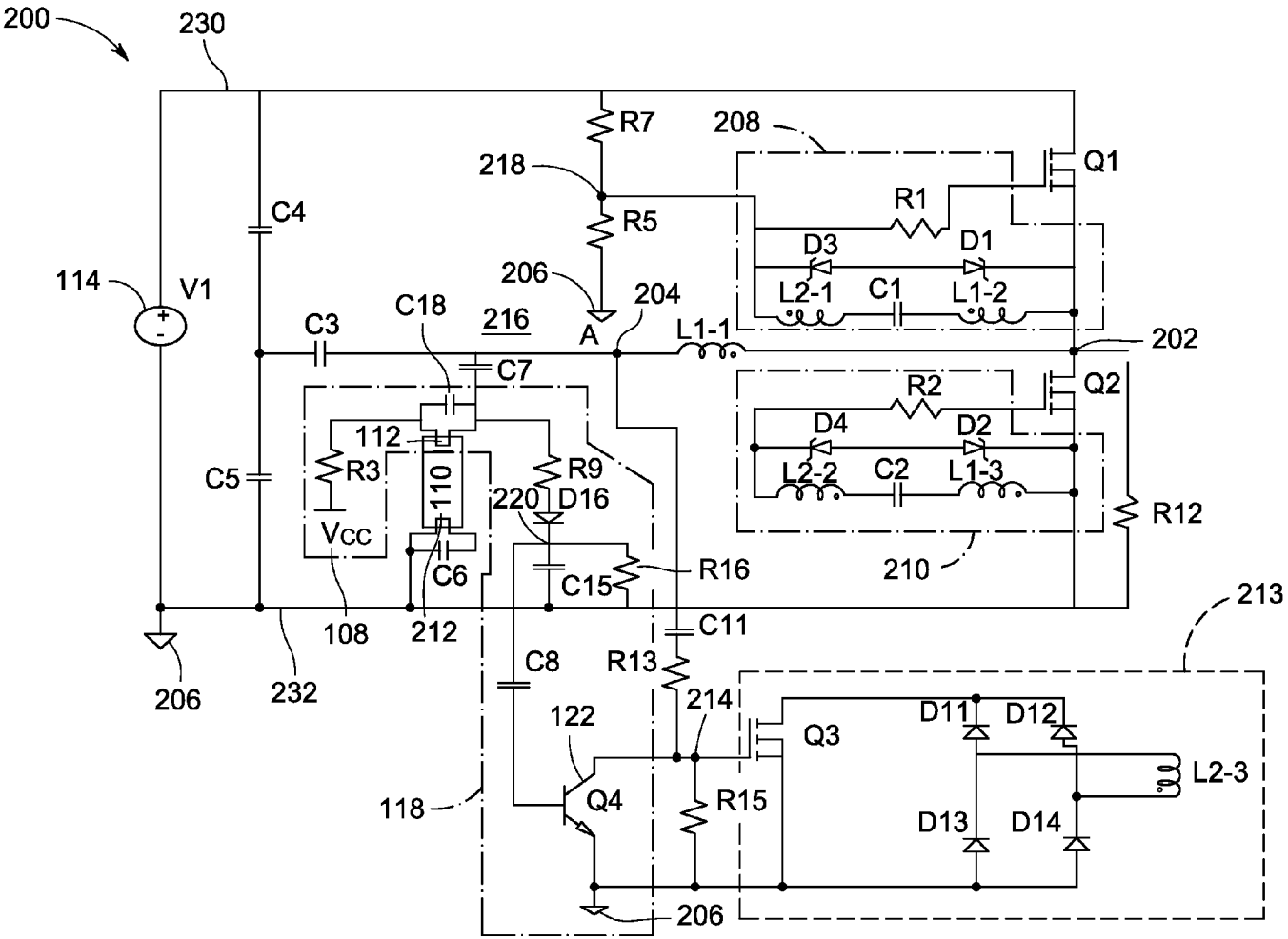
FIG. 2 illustrates a schematic diagram of an exemplary resonant inverter type lamp ballast incorporating aspects of the present disclosure.

FIG. 2 illustrates a detailed schematic diagram of one embodiment of a resonant inverter 200 type lamp ballast that includes an embodiment of the relamping circuit topology 118 described above to provide relamping functionality. The resonant inverter 200 receives a DC supply voltage (V1) 114 onto a positive supply rail 230 and a negative return rail 232. The DC supply voltage 114 is chopped by a pair of switching devices Q1, Q2 to produce an AC square wave voltage at circuit node 202. The switching devices Q1, Q2 are shown as metal oxide semiconductor field effect transistors (MOSFETs) in the illustrated inverter embodiment 200. However those skilled in the art will recognize that any suitable type of semiconductor switching device may be advantageously employed. A resonant circuit, generally indicated by numeral 216, is formed by the combination of inductor L1-1 and capacitors C3, C4, C5. The resonant circuit 216 receives the AC square wave 202 and produces a high-frequency AC signal at a common circuit node 204 located between the resonant inductor L1-1 and resonant capacitor C3. A ballasting capacitor C7 transfers the high-frequency signal 204 to the lamp 110. One filament 112 of the gas discharge lamp 110 is coupled to the ballasting capacitor C7 while the second filament 212 of the lamp 110 is coupled to the circuit ground 206. The second filament 212 is coupled to blocking capacitor C6, the function of which is similar to blocking capacitor C18.

Each switching device Q1, Q2 is controlled by a switch drive circuit 208 and 210. The switch drive circuits 208, 210 are magnetically coupled to a primary winding L1-1 of the resonant circuit 216 through secondary windings L1-2 and L1-3 which are connected in opposite polarity in the respective switching drive circuits 208, 210 to facilitate alternate switching of the transistors Q1 and Q2 to produce the AC square wave signal 202. Each switch drive circuit 208, 210 is coupled to its respective switching device Q1, Q2 through a series connected resistor, R1 and R2 respectively. Pairs of Zener diodes, D1, D3 and D2, D4, are included to provide voltage protection for the switching devices Q1 and Q2 respectively. Series LC circuits, one LC circuit formed by inductors L1-2, L2-1 and capacitor C1, and a second LC circuit formed by inductors L1-3, L2-2 and capacitor C2, provide drive power in the switching circuits 208, 210, respectively. The phase shift inductors L2-1, L2-2 in each drive circuit 208, 210, are each magnetically coupled in opposite polarity to a frequency control circuit 213 through a tertiary winding L2-3. The tertiary winding L2-3 of the phase shift control inductors L2-1, L2-2 is coupled to a diode bridge formed by diodes D11, D12, D13, D14 in the frequency control circuit 213 where a transistor Q3 is coupled to the diode bridge and is configured to adjust the current flowing through the tertiary winding L2-3. A series connected capacitor C11, resistor R13, and resistor R15 create a control voltage at circuit node 214 that is proportional to a voltage of the high-frequency AC signal at node 204. The control voltage at node 214 is used to drive the transistor Q3 to adjust the current flowing through the tertiary winding L2-3, thereby adjusting the inductance of the frequency control inductors L2-1, L2-2 to regulate the frequency of the AC voltage produced at node 202. By moving the frequency of the AC voltage at node 202 closer to or farther away from the resonant frequency of the resonant circuit 216, the voltage of the high-frequency signal 204 can be increased or decreased respectively, thus regulating the voltage of the high-frequency signal 204 at a desired level. Resistors R5, R7, and R12 form a starting circuit to initiate oscillatory operation of the inverter 200. Resistors R7 and R5 form a resistor divider network connected between the positive supply voltage 114 and circuit ground 206, with their common node 218 coupled through resistor R1 to the switching device Q1.

A relamping circuit 118 configured with the relamping topology described above is included to provide a relamping signal at circuit node 214 to control the transistor Q3 of the frequency control circuit 213. In the relamping circuit illustrated in FIG. 2, a DC voltage is supplied by a common collector voltage, Vcc, shown in FIG. 1 as 108, which is also used elsewhere as a supply for low level control logic (not shown). Alternatively, the DC supply voltage can be provided by a dedicated circuit such as for example by a resistor divider network or other suitable DC voltage supply circuit. In steady state operation the low voltage power from Vcc is fed through resistor R3, lamp filament 112, resistor R9 and diode D16 to circuit node 220. A voltage filter is formed by filter capacitor C15 and resistor R16 to smooth power at node 220. Thus there is no voltage change on the differential capacitor C8 and transistor Q4 remains in the off state and no relamping signal 122 is applied to circuit node 214 and the inverter frequency remains unchanged. When the lamp 110 is removed or the filament 112 breaks, the low level power passing from resistor R3 to resistor R9 is blocked by differential capacitor C8. The voltage at circuit node 220 is drained through resistor R16 resulting in a high to low voltage transition being applied to the differential capacitor C18. Transistor Q4 remains off and the inverter frequency is unchanged. When a new lamp 110 is installed in the fixture, the low level power from the DC supply Vcc 108 flows through R3, through the filament 112, resistor R9 and diode D16 where it charges the filter capacitor C15 resulting in a low to high voltage being applied to the differential capacitor C8. This causes the differential capacitor C8 to apply a negative pulse to transistor Q4, which turns transistor Q4 on to produce a relamping signal 122 at circuit node 214. The relamping signal 122 at node 214 is applied to transistor Q3 of the inverter frequency control circuit 213 resulting in a lowering of the inverter frequency moving the frequency of the AC voltage at node 202 closer to the resonant frequency of the resonant circuit 216 thereby creating a high ignition voltage at node 204 which is applied to ignite the newly installed lamp 110.

Figure 3:
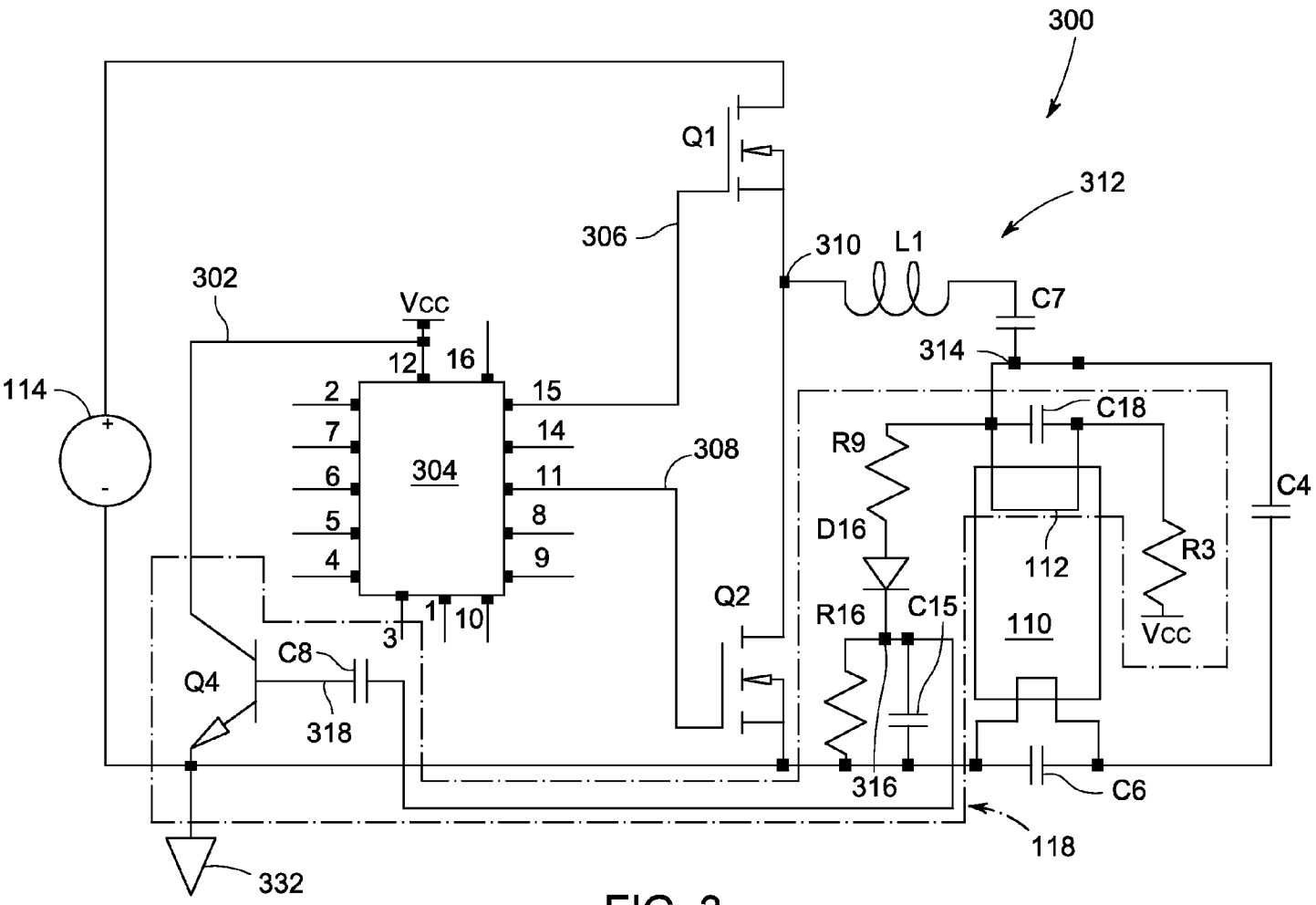
FIG. 3 illustrates an exemplary resonant inverter lamp ballast incorporating aspects of the present disclosure.

FIG. 3 illustrates a schematic diagram of a lamp ballast 300, which includes an integrated circuit 304 to control the inverter switching devices Q1 and Q2. In this embodiment, the lamp ballast 300 illustrates how the relamping circuit topology 118 may be advantageously employed to provide relamping functionality in a lamp ballast that includes an integrated circuit 304. The integrated circuit 304 may be any integrated circuit suitable for operating a lamp ballast such as for example a L6574 ballast driver from STMICROELECTRONICS of Italy or another type of integrated microcontroller or driver circuit. As illustrated in FIG. 3, the integrated circuit 304 receives a common collector voltage, Vcc, from a suitable low level DC source (not shown) such as for example a secondary winding magnetically coupled to the resonant inductor L1 and rectified to produce a low level DC voltage. The integrated circuit 304 outputs two drive signals 306 and 308 which are each coupled to a respective switching device Q1, Q2 and controlled to alternately enable the switching devices Q1, Q2 to produce an AC square wave voltage at a central node 310. The AC square wave voltage 310 drives a series resonant circuit, generally indicated by numeral 312, which includes a combination of an inductor L1 and a pair of capacitors C7 and C4. The resonant circuit 312 generates a high-frequency AC voltage at a common node 314 between the two resonant capacitors C7 and C4. The high-frequency AC voltage is used to drive the lamp 110. While only a single lamp is illustrated in the embodiment shown in FIG. 3, one or more lamps can be driven by the lamp ballast 300.

A relamping circuit 118 is included to provide a relamping signal whenever a lamp 110 is replaced. In the embodiment illustrated in FIG. 3, the relamping circuit 118 receives a low level DC voltage, Vcc, from the same common collector voltage supply (not shown) used to provide Vcc to the integrated circuit 304. A current path is formed by a series connected resistor R3, lamp filament 112, second resistor R9, and a diode D16, to allow current to flow from the low level voltage Vcc to the differential capacitor C8. This current path provides a DC current to charge the differential capacitor C8. A voltage filter comprising a combination of resistor R16 and a capacitor C15 is connected to the differential capacitor C8 at circuit node 316 to stabilize the voltage on the differential capacitor C8. The differential capacitor C8 is coupled to the control terminal 318 of a transistor Q4 such that changing the voltage on the differential capacitor C8 causes the relamping signal 302 to be selectively connected to circuit ground 332.

When the lamp 110 is removed or fails, the relamping signal 302 remains inactive and the ballast continues to operate normally. When the lamp 110 is replaced, the relamping signal 302 is activated, i.e. a positive going voltage on the differential capacitor C8 causes the transistor Q4 to be turned on. Activation of the relamping signal 302 causes the common collector voltage Vcc supplied to the integrated circuit 304 to fall below a starting threshold thereby causing the integrated circuit 304 to reset and repeat the lamp ignition cycle so the newly replaced lamp 110 can be ignited.

Figure 4:
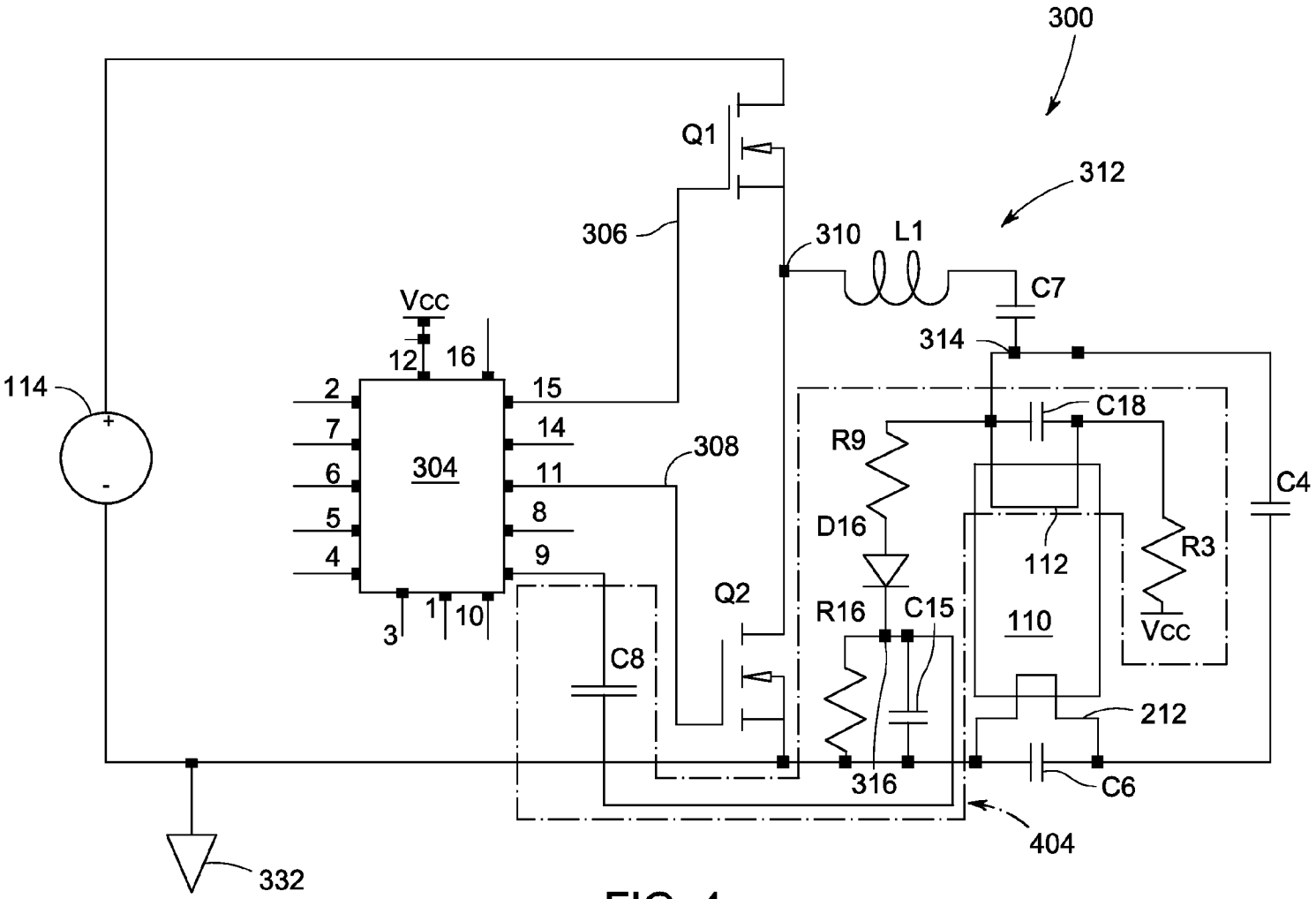
FIG. 4 illustrates an exemplary resonant inverter lamp ballast incorporating aspects of the present disclosure.

FIG. 4 illustrates an alternative embodiment of the relamping topology described herein as used in the lamp ballast 300 described above. The relamping circuit 404 shown in FIG. 4 uses a current path similar to the one 0used in relamping circuit 118 described with respect to FIG. 3 above. The current path, which includes the low level DC voltage Vcc, a resistor R3, the lamp filament 112, a resistor R9, a diode D16, provides charging current to the differential capacitor C8. A resistor R16 and a capacitor C15 are configured as a voltage filter to stabilize the voltage of the differential capacitor C8. However, the alternative relamping circuit 404 does not include a transistor Q4, which is shown in FIG. 3, to control the relamping signal as is done in the previously described relamping circuit 118. The integrated circuit 304 is configured to have a restart enable input 9 that, when activated, will re-start the lamp startup sequence. The differential capacitor C8 in relamping circuit 404 can activate the restart enable input 9 without including a transistor.

Power conversion apparatus that use an inverter, such as for example the inverter 102 illustrated in FIG. 1, to drive a resonant circuit, such as for example the resonant inductor L1 and capacitor C7 illustrated in FIG. 1, are generally known as resonant inverters. Those skilled in the art will recognize that various types of resonant inverters may be used may be used in conjunction with the relamping circuits described herein to drive gas discharge lamps without straying from the spirit and scope of the disclosure.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit and scope of the invention. Moreover, it is expressly intended that all combinations of those elements, which perform substantially the same function in substantially the same way to achieve the same results, are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A relamping circuit for a ballast circuit of a gas discharge lamp, the relamping circuit comprising:
- a low level DC power source;
- a differential capacitance;
- a switching device coupled to the differential capacitance and configured to produce a relamping signal; and
- an electric current path configured to direct a flow of direct current from the low level DC power source through a filament of the gas discharge lamp to the differential capacitance;
- wherein breaking and restoring the electric current path activates the relamping signal.

2. The relamping circuit of claim 1, the electric current path comprising a resistance, a diode, and the filament connected in series between the low level DC power source and the differential capacitance.

3. The relamping circuit of claim 2, comprising a voltage filter coupled to the differential capacitance and configured to stabilize a voltage across the differential capacitance.

4. The relamping circuit of claim 2, comprising a blocking capacitance coupled in parallel with the filament.

5. The relamping circuit of claim 1, the gas discharge lamp comprising a heated filament gas discharge lamp, wherein the heated filament gas discharge lamp comprises a plurality of heated filament gas discharge lamps and wherein the current path is further configured to direct the flow of current through at least one filament of each of the plurality of heated filament gas discharge lamps.

6. A power conversion apparatus for operating a heated filament gas discharge lamp, the power conversion apparatus comprising:
- a resonant inverter configured to produce an AC lamp power;
- a relamping circuit coupled to at least one filament of the lamp and configured to produce a relamping signal; and
- a frequency controller coupled to the resonant inverter and configured to regulate a frequency of the AC lamp power at an ignition frequency and at an operating frequency,
- wherein the relamping circuit comprises:
  - a low level DC power source;
  - a differential capacitance;
  - a switching device coupled to the differential capacitance and configured to produce the relamping signal; and
  - an electric current path configured to direct a flow of direct current from the low level DC power source through a filament of the gas discharge lamp and to the differential capacitance, where breaking and restoring the electric current path activates the relamping signal; and
- the relamping signal is coupled to the frequency controller and activation of the relamping signal causes the frequency controller to regulate the inverter at the ignition frequency for a predetermined period of time and then regulate the inverter at the operating frequency.

7. The power conversion apparatus of claim 6, wherein the frequency controller comprises an integrated circuit configured to receive an operating voltage from the low level DC power source, the relamping signal is coupled to the integrated circuit and activation of the relamping signal reduces the operating voltage to start a lamp startup sequence.

8. The power conversion apparatus of claim 6, wherein the electric current path comprises a resistance, a diode, and the filament connected in series between the low level DC power source and the differential capacitance.

9. The power conversion apparatus of claim 6, comprising a voltage filter coupled to the differential capacitance and configured to stabilize a voltage across the differential capacitance.

10. The power conversion apparatus of claim 6, comprising a blocking capacitance coupled in parallel with the filament.

11. The power conversion apparatus of claim 6, wherein the heated filament gas discharge lamp comprises a plurality of heated filament gas discharge lamps and wherein the current path is configured to direct the flow of current through at least one filament of each of the plurality of heated filament gas discharge lamps.

12. The power conversion apparatus of claim 11, comprising a blocking capacitance coupled in parallel with a respective one of the at least one filaments.

13. A power conversion apparatus configured to operate a heated filament gas discharge lamp, the power conversion apparatus comprising:

a resonant inverter configured to produce an AC lamp power;

a relamping circuit coupled to the resonant inverter and to a filament of the lamp, the relamping circuit configured to produce a relamping signal; and a frequency controller comprising an integrated circuit configured to operate the inverter in a lamp startup sequence and at a lamp operating frequency, and wherein the integrated circuit comprises a resetting input configured to start a lamp startup sequence, wherein the relamping circuit comprises:

a low level DC power source;

a differential capacitance;

a resistance coupled to the differential capacitance and to the resetting input to apply a relamping signal to the resetting input; and an electric current path configured to direct a flow of direct current from the low level DC power source through a filament of the gas discharge lamp and to the differential capacitance, wherein breaking and restoring the electric current path activates the relamping signal and causes the integrated circuit to start the lamp startup sequence.

14. The power conversion apparatus of claim 13, wherein the electric current path comprises a resistance, a diode, and the filament connected in series between the low level DC power source and the differential capacitance.

15. The power conversion apparatus of claim 13, comprising a voltage filter coupled to the differential capacitance and configured to stabilize a voltage across the differential capacitance.

16. The power conversion apparatus of claim 14. comprising a blocking capacitance coupled in parallel with the filament.

17. The power conversion apparatus of claim 14, wherein the heated filament gas discharge lamp comprises a plurality of heated filament gas discharge lamps and wherein the current path is further configured to direct the flow of current through at least one filament of each of the plurality of heated filament gas discharge lamps.

18. The power conversion apparatus of claim 17, comprising a blocking capacitance coupled in parallel with each filament.

* * * * *